US005687662A

United States Patent [19]

Kawasaki

[11] Patent Number: 5,687,662

[45] Date of Patent: Nov. 18, 1997

[54] SEWING METHOD FOR FORMING A TRIM COVER ASSEMBLY

[75] Inventor: Kiyoshi Kawasaki, Akishima, Japan

[73] Assignee: Tachi-S Co., Ltd., Tokyo, Japan

[21] Appl. No.: 609,525

[22] Filed: Mar. 1, 1996

[51] Int. Cl.[6] ..... D05B 11/00

[52] U.S. Cl. ..... 112/475.08; 112/475.03; 112/470.31; 112/470.27; 112/308

[58] Field of Search ..... 112/153, 308, 112/309, 305, 306, 470.31, 470.14, 470.35, 470.27, 475.03, 475.08, 475.07, 470.09, 148

[56] References Cited

U.S. PATENT DOCUMENTS

| | | | |
|---|---|---|---|
| 4,899,674 | 2/1990 | Kawasaki . | |
| 4,899,675 | 2/1990 | Kawasaki . | |
| 4,928,609 | 5/1990 | Kawasaki | 112/308 X |
| 5,129,556 | 7/1992 | Gratsch | 112/308 X |

FOREIGN PATENT DOCUMENTS

| | | |
|---|---|---|
| 54-72966 | 5/1979 | Japan . |
| 61-276587 | 6/1986 | Japan . |
| 5-305194 | 11/1993 | Japan . |
| 6-285283 | 10/1994 | Japan . |
| 7-194870 | 8/1995 | Japan . |

*Primary Examiner*—Paul C. Lewis
*Attorney, Agent, or Firm*—Browdy and Neimark

[57] ABSTRACT

A method for sewing a curved edge of first base cover material with a second base material to form a trim cover assembly. The first base cover material is elastically deformed, as by expanding or contracting the same, such as to transform its curved edge into a rectilinear edge, and then, the thus-formed rectilinear edge of first base material is sewn with the second base material, whereby a trim cover assembly can be formed easily, using simple guide and retaining members.

15 Claims, 4 Drawing Sheets

SEWING METHOD FOR FORMING A TRIM COVER ASSEMBLY

BACKGROUND OF INVENTION

1. Field of the Invention

The present invention relates to a sewing method for forming a trim cover assembly for use in an automotive seat, and in particular, to a method for sewing a curved or arcuate edge of a base material with other base material to form a trim cover assembly for an automotive seat.

2. Description of Prior Art

FIG. 2 shows a first base material (1) and a second base material (2) which are to be sewn together to form a trim cover assembly covering a right-side central section in a seat back (SB) of an automotive seat shown in FIG. 1. The first base material (1) has a convexly curved edge (1A) in contrast to a rectilinear edge (2A) of the second base material (2), because the two materials (1)(2) are to be sewn together to assume a predetermined three-dimensional warped trim cover assembly as shown in FIG. 12, which conforms to a cambered swollen surface of the corresponding area of a cushion member (C) of the seat.

In FIG. 2, designations (11A)(12A) indicate the respective phantom sewing lines in the edge (1A) of first base material (1) and the edge (2A) of second base material (2). Also, in FIG. 3, designation (11'A) indicates a phantom sewing line of another first base material (1'). Along each of the sewing lines, a sewing is effected to connect together the first and second base material's edges (1A or 1'A)(2A).

Conventionally, a worker takes the two separate base materials (1)(2) and uses his or her hands to juxtapose their respective edges (1A)(2A) with each other and sew them together along the sewing lines (11A)(12A). Such hand sewing procedures are troublesome and require much labor of the worker.

The same goes for the case shown in FIG. 3, where the concavely curved edge (1'A) of another first base material (1') is to be sewn with the rectilinear edge (2A) of second base material (2) to form another mode of three-dimensional trim cover assembly as in FIG. 13, which corresponds to the right-side central section in the seat back (SB) as viewed from FIG. 1.

In an attempt to solve this problem, there has been known various automated sewing machines which permit for automatically sewing a curved edge of one base material with a rectilinear edge of another material. For example, the Japanese U.M. Laid-Open Pub. No. 54-72966 discloses such automated sewing machine wherein one base material having a curved edge is retained between two guide plates, and its curved edge is subject to sewing with a rectilinear edge of another base material, while the guide plates are being guided by two guide members. On the other hands, such sewing is achieved by means of a movable guide plate having guide rollers and a stationary plate having plural guide grooves formed thereon, as disclosed in the U.S. Pat. No. 4,899,674 for example, so that the movable guide plate is moved along the grooves in predetermined directions to sew the curved edge of one base material with the rectilinear edge of another material.

However, those prior-art automated sewing techniques have been sill found complicated in mechanisms and troublesome in changing the guide plates, guide members and guide groove patterns for each of different base materials having different curved edges.

SUMMARY OF THE INVENTION

In view of the above-stated shortcomings, it is therefore a primary purpose of the present invention to provide an improved sewing method for forming a trim cover assembly, by which each different base material with different curved edge can be easily sewn with another base material.

In order to achieve such purpose, in accordance with the present invention, there is basically provided the steps of:

- preforming a first base material from an expansible elastic material;
- providing a guide means for securing thereon the first base material and a second base material, and guiding them towards a sewing machine;
- deforming the first base material elastically from an original shape thereof in such a manner as to transform the curved edge thereof into a provisional rectilinear edge;
- retaining the thus-deformed first base material with the provisional rectilinear edge, upon the guide means;
- thereafter, placing the second base material onto the deformed first base material retained on the guide means, such that the edge of the second base material is juxtaposed with the provisional rectilinear edge of the deformed first base material;
- causing the guide means, on which the deformed first base material and the second base material are placed, to be moved towards the sewing machine;
- sewing the edge of the second base material with the provisional rectilinear edge of the deformed first base material by means of said sewing machine; and
- thereafter, removing the deformed first base material and the second base material from the guide means, whereby the first base material is elastically recovered into the original shape, with the provisional rectilinear edge thereof being returned to the curved edge.

Accordingly, the simple elastic deformation of the first base material renders its curved edge a rectilinear edge provisionally and thus permits easy sewing of the curved edge of first base material with the edge of second base material. For example, two lateral portions of first base material may be expanded away from or contracted towards each other to flatten or upheave the convexly or concavely curved edge thereof into a rectilinear edge provisionally. This is also effective in sewing the curved edge with a rectilinear edge of second base material.

Other various features and advantages of the present invention will become apparent from reading of the descriptions hereinafter, with reference to the annexed drawings.

DETAILED DESCRIPTION OF PREFERRED EMBODIMENT OF THE INVENTION

Figure 1:
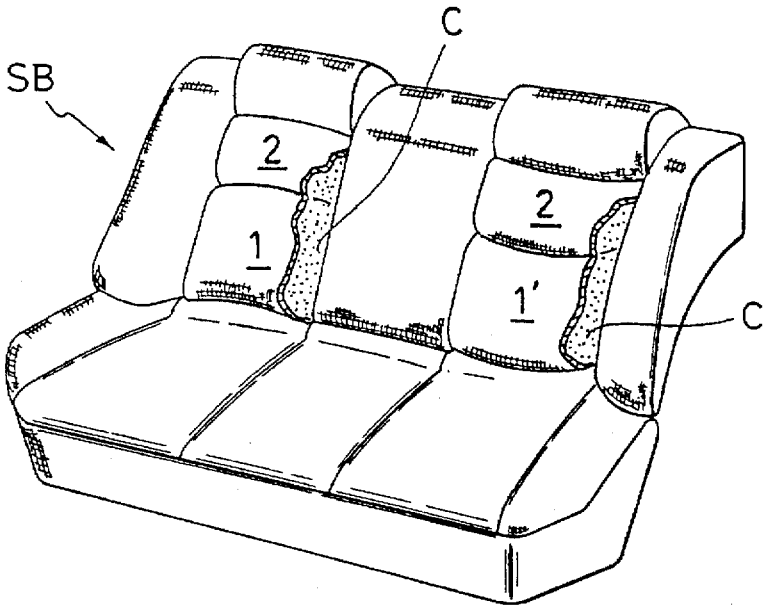
FIG. 1 is a partly broken schematic perspective view of an automotive seat in which are used trim cover assemblies formed in accordance with the present invention.

According to the embodiments shown in FIGS. 2 through 13, there are used two different sorts of base materials with their respective curved or arcuate edges. Namely, as best seen from FIGS. 2 and 3, in accordance with the present invention, two typical different first base materials (1)(1') are used, by way of example, each of which is formed with a convexly curved edge (1A) and a concavely curved edge (1'A), respectively. As will become understood later, one of those two different curved edges (1A)(1'A) may be easily sewn with a rectilinear edge of a second base material (2) through the steps and associated guide elements of the present invention.

As shown, the two first base materials (1)(1') are each equal in width to the respective two second base materials (2)(2). In other words, the edge (2A) of second base material (2) is equal in length to the rectilinear edge (1B) of first base material (1) as in FIG. 2, and also equal in length to the rectilinear edge (1'B) of another first base material (1'), as in FIG. 3.

Figure 2:
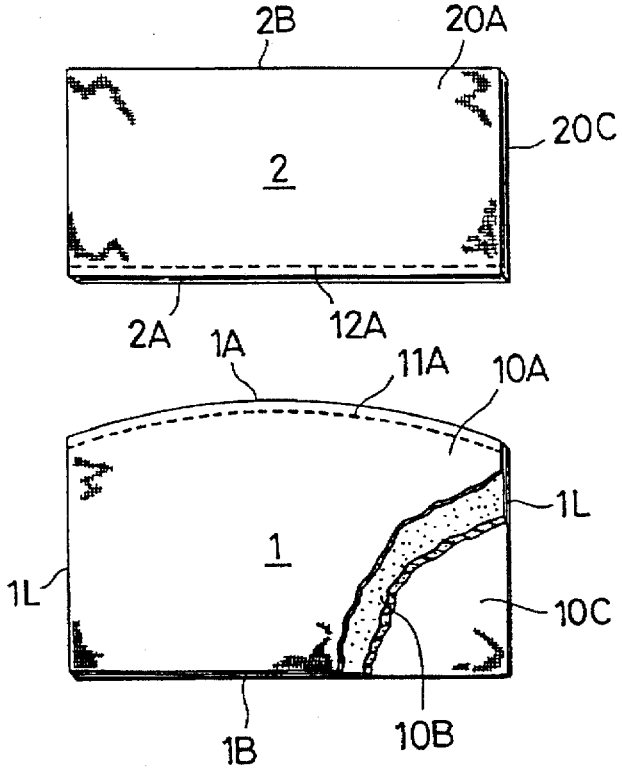
FIG. 2 is a partly broken schematic perspective view of first and second base materials.
Figure 3:
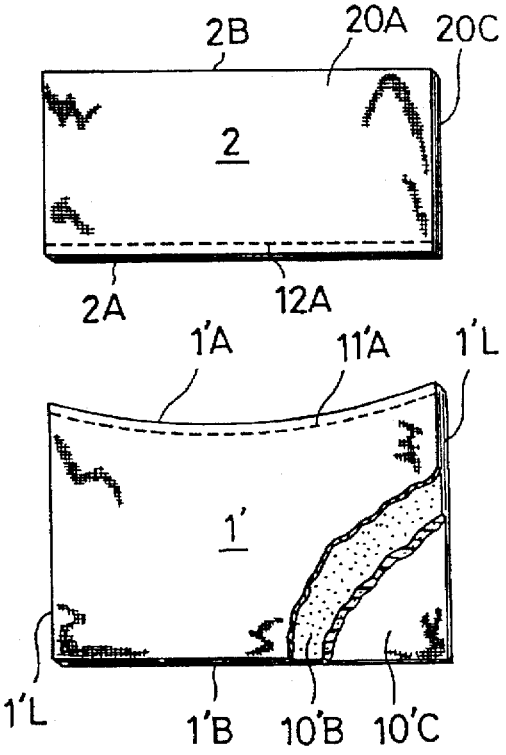
FIG. 3 is a partly broken schematic perspective view of another first and second base materials.

Further, the first base material (1 or 1') is of a three-layer lamination structure, as shown in FIGS. 2 and 3, which comprises a expansible elastic top cover layer (10A or 10'A), a slab urethane foam wadding layer (10B or 10'B) and an expansible elastic back cloth layer (10C or 10'C). Both top cover layer (10A or 10'A) and back cloth layer (10C or 10'C) may be formed from any cloth material having an elasticity enough to permit them to be elastically deformable (i.e. expansible and contractible) for achieving the purpose of the present invention. For example, a woven fabric material can be used for the top cover layer (10A or 10'A) and a non-woven fabric material for the back cloth material (10C or 10'C).

Figure 4:
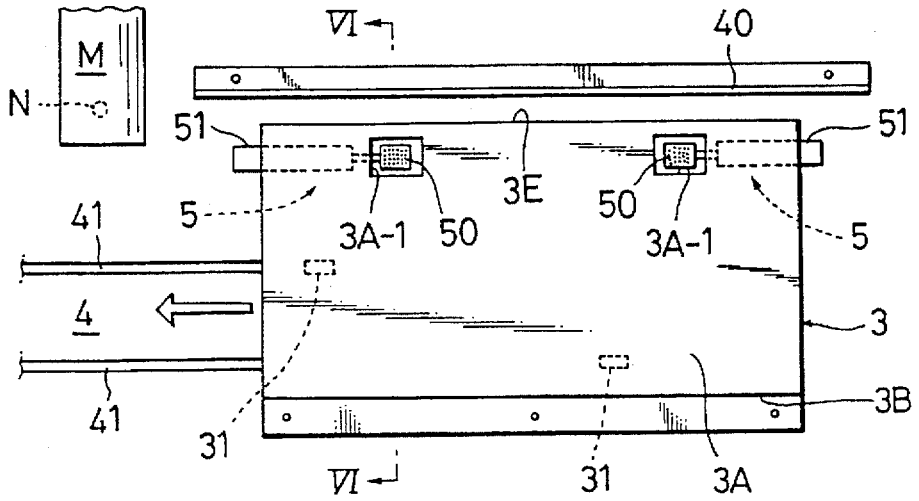
FIG. 4 is a schematic plan view of guide members and sewing machine used in the present invention.
Figure 5:
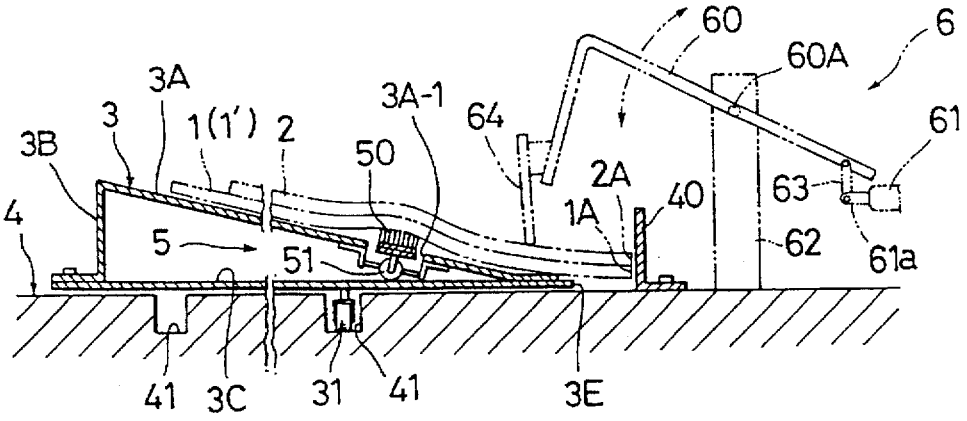
FIG. 5 is a sectional view taken along the line VI—VI FIG. 4.

FIG. 4 illustrates a guide device, in plan, in accordance with the present invention. The guide device is designed to secure the foregoing first and second materials thereon and guide them towards a sewing machine (M). Specifically, with reference to FIGS. 4 to 7, upon a table (4) of the sewing machine (M), there are arranged a pair of spaced-apart guide grooves (41)(41) and a movable guide member (3) having at least two guide rollers (31) to be slidably fitted in the respective two guide grooves (41). The guide grooves (41) are formed in the table (4), extending rectilinearly along a sewing direction of the sewing machine (M). The movable guide member (3) is directly placed on the table (4) in a slidable contact therewith and has the guide rollers (31) provided at the flat bottom section (3C) thereof. Thus, the guide member (3) is free to slide on the table (4) along the sewing direction via the guide rollers (31) slidably fitted in the respective two guide grooves (41). Although not shown, a suitable actuator, such as a pneumatic cylinder, is provided in this guide device, which is operable to cause the guide member (3) to be moved towards the sewing machine (M) and returned to a home position shown in FIG. 4. The guide member (3) is so formed to have a downwardly inclined upper securing section (3A) and an upstanding section (3B), which are fixed on the flat bottom section (3C), as best shown in FIG. 5. The upper securing section (3A) is inclined from the top of upstanding section (3B) down to an edge (3E) spaced a predetermined distance from a stationary guide member (40). The stationary guide member (40) erects fast from the table (4) and extends from the home position where the movable guide member (3) is normally set, to a point in the proximity of the sewing machine (M), thus providing a vertical guide surface alongside of the guide member (3).

In the inclined upper securing section (3A) of guide member (3), a pair of spaced-apart openings (3A-1)(3A-1) are perforated such as to be arrayed in a line along the direction wherein the movable guide member (3) moves.

Figure 6:
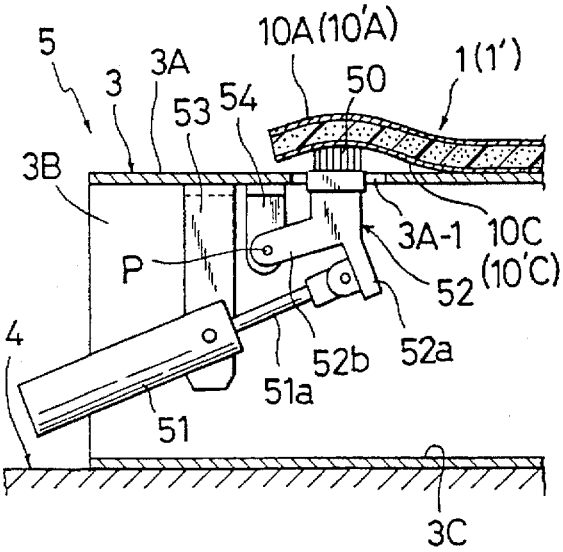
FIG. 6 is a fragmentary sectional view of a movable guide member, showing the state where a retaining device provided therein is operated to retain the first base material.
Figure 7:
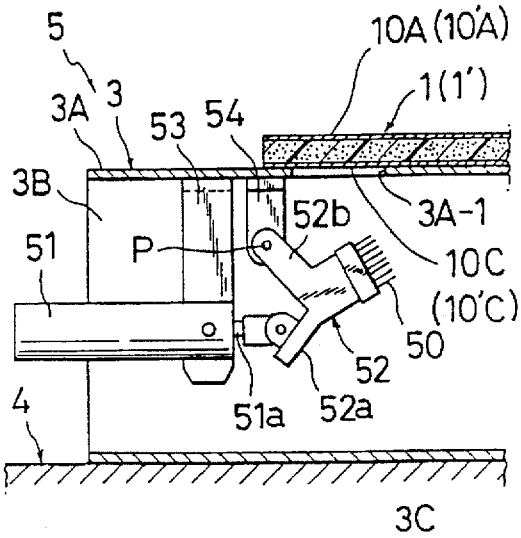
FIG. 7 is a fragmentary sectional view of the movable guide member, showing the state where the retaining device provided therein is set in a non-use condition.
Figure 8:
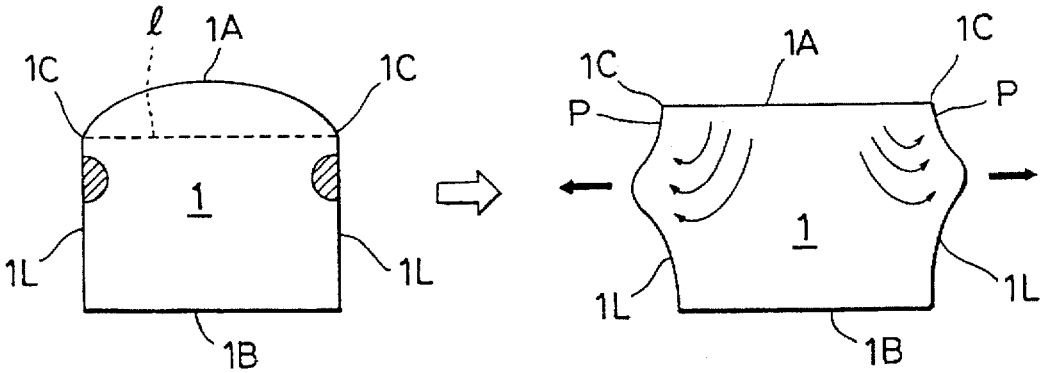
FIG. 8 is a diagram explaining how to expand one first base material to transform its convex edge into a rectilinear edge.

Designation (5) denotes a pair of retaining devices (5)(5) for retaining the two lateral edge portions (1L)(1L) of one first base material (1) or the two lateral edge portions (1'L)(1'L) of another base material (1'). As can be seen from FIGS. 4 to 7, each of the devices (5) comprises: a generally Y-shaped rotatable link (52); a set of plural needles (50) fixed on a base end of the rotatable link (52); a support bracket (54) for supporting the rotatable link (52); a pneumatic cylinder (51); and a support bracket (53) for supporting the pneumatic cylinder (51). As shown, the retaining devices (5)(5) are arranged in a space between the inclined upper section (3A) and flat bottom section (3C) of movable guide member (3), such that each of them is disposed adjacent to the respective two openings (3A-1)(3A-1) formed in the upper section (3A) of guide member (3). Referring to FIGS. 6 and 7, the generally Y-shaped rotatable link (52) has one end (52*a*) pivotally connected to a cylinder rod (51*a*) of the cylinder (51), and another end (52*b*) pivotally connected to the support bracket (54). The cylinder (51) is journalled rotatably to the support bracket (53). Operating the cylinder (51) causes vertical rotation of the rotatable link (52) about the pivot (P), which in turn causes a set of plural needles (50) to be passed through the opening (3A-1) to project from the upper section (3A) of movable guide member (3), as in FIG. 6, for the purpose of retaining the first base material (1 or 1') as will be described later, and causes the same needles (50) to be withdrawn from the opening (3A-1) down to a level below the reverse side of the movable guide member's upper section (3A) as in FIG. 7, whereby the needles (50) are displaced away from the first base material (1 or 1'). Normally, the two sets of plural needles (50) are set in a use position as shown in FIG. 6, projecting from the upper section (3A) though the respective two openings (3A-1)(3A-1).

Designation (6) in FIG. 5 denotes a pressing device for applying a pressure to the juxtaposed end parts of first and second base materials (1)(2) or (1')(2) and retaining them at a predetermined setting point against movement upon the movable guide member (3). In brief, the construction of the pressing device (6) is such that a pressure piece (64) is connected via arm (60) and link (63) to the cylinder rod (61*a*) of a pneumatic cylinder (61), wherein the arm (60) is rotatably supported at a pivot (60A) of a support pillar (62), and that operating the cylinder (61) will cause vertical rotation of the arm (60) about the pivot (60A), as indicated by the arrow, so as to raise and lower the pressure piece (64) from and towards the end portion (3E) of movable guide member (3), at which, as will become understood, the juxtaposed end parts of first and second base materials (1)(2) or (1')(2') are to be placed.

In accordance with the present invention, there is a novel first step wherein a worker uses his or her hands to directly expand or contract both lateral end portions of first base material (1 or 1') such as to flatten or upheave the curved edge of same first material, exploiting the elastic property of material, in order to provide a provisional rectilinear edge that can be readily sewn with the rectilinear edge of second material (2). But, this is not limitative, and, in general, it is possible within the gist of the present invention to elastically deform an elastic first base material having a curved edge, in any proper fashion, to transform the curved edge into a rectilinear edge provisionally.

Figure 10:
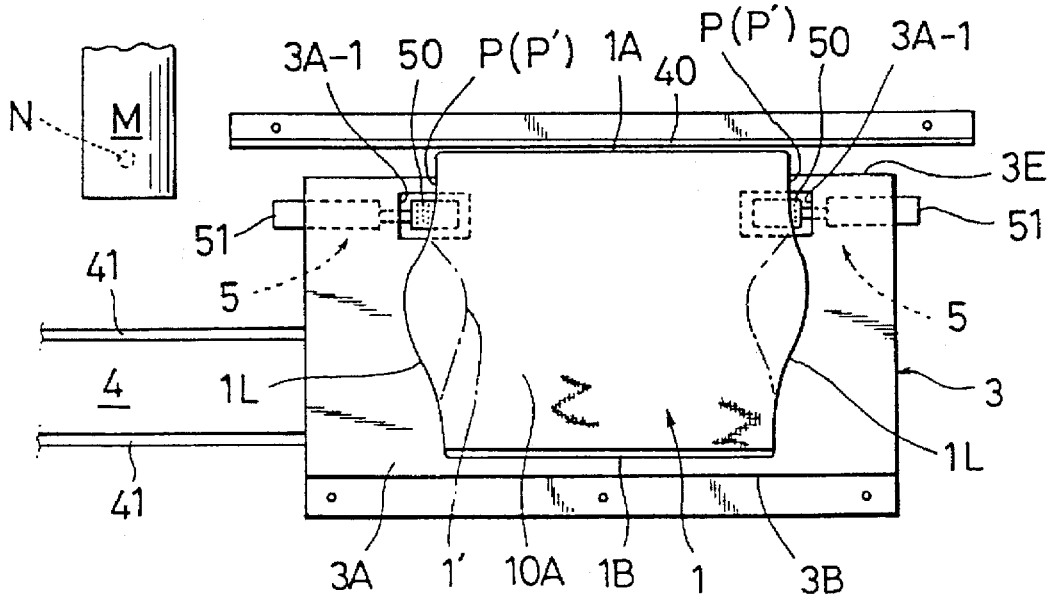
FIG. 10 is a schematic plan view 'showing the state where the expanded or contracted first base material is retained and secured on the movable guide member.

Reference is now made to FIG. 2 showing the first base material (1) with a convexly curved edge (1A). In this case, a worker grasps two upper areas respectively of two lateral edge portions (1L)(1L) of the first base material (1), with his or her two respective hands, as indicated by the hatching in FIG. 8, which are each near to the two respective upper corners (1C)(1C) of same base material (1), while leaving a non-expanded margin (P) in each of the two respective lateral edges (1L)(1L) between the hatched grasped area and the upper corner (1C). Then, while abutting the curved edge (1A) of first base material (1) against the stationary guide member (40), he or she should expand those two particular hatched parts of same base material (1) outwardly away from each other, as indicated by the two thick arrows in FIG. 8, to the degree at which the convexly curved edge (1A) is transformed into a rectilinear edge provisionally. Here, it is important that, as indicated by the plural small arrows in FIG. 8, the worker should expand those two hatched parts of base material (1) away from each other in upward directions, by an amount that absorbs or counterbalances a generally semi-circular area defined between the arc (1A) and a cord (l), as understandable from FIG. 8, such as t0 form the provisional rectilinear edge (1A) equal in length to the opposite rectilinear edge (1B). Thereafter, as shown in FIG. 10, the two non-expanded margins (P)(P) of base material (1) are each placed on the respective two sets of plural needles (50)(50) projected from the upper section (3A) of movable guide member (3), so that, as best shown in FIG. 6, the back cloth layer (1C) of same material (1) is stuck and caught by the needles (50). In this way, the provisional rectilinear edge (1A) of base material (1) is retained at a predetermined position, as it is shown in FIG. 10, against deformation, by means of the two retaining devices (5)(5) and one stationary guide member (40). Then, the whole sheet of base material (1) is placed on the movable guide member (3), as shown. At this step, of course the retaining devices (5)(5) have been operated, in advance, to bring their respective two sets of plural needles (50)(50) to the normal use position, as can be seen in FIG. 5, projecting through the respective two openings (3A-1)(3A-1) formed in the upper section (3A) of movable guide member (3).

Figure 11:
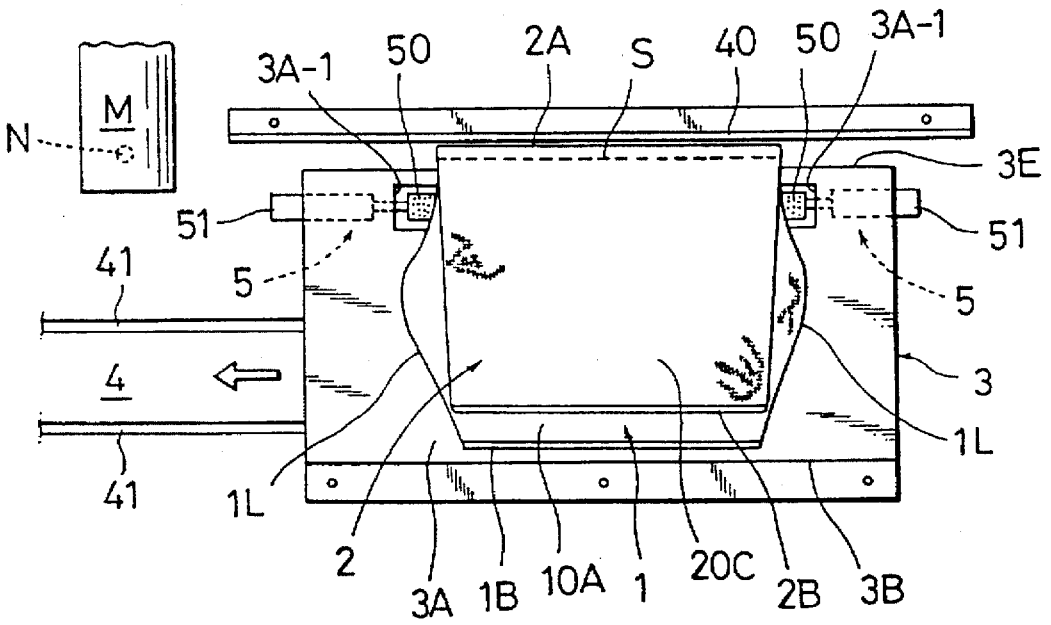
FIG. 11 is a schematic plan view showing the state where the second base material is juxtaposed on the expanded or contracted first base material on the movable guide member.

Next, as understandable in FIG. 11, the worker takes and turns upside down the second base material (2) show up its frontal surface (20A), and then places it onto the frontal surface (1A) of first material (1) secured on the movable guide member (3), such that the rectilinear edge (2A) of the former (2) is juxtaposed fit with the thus-formed provisional rectilinear edge (1A) of the latter (1), while being abutted along and against the stationary guide member (40). Thereafter, the pressing device (6) is operated to lower and press its pressure piece (64) gently against the area of the juxtaposed first and second base materials (1)(2) adjacent to their respective rectilinear edges (1A)(2A), as indicated by the two-dot chain lines in FIG. 5, whereby the second base material (2) is retained on the first base material (1). In this respect, the amount of pressure from the pressure piece (64) should be such low as to only retain the second material (2) against dislocation from the first material (2) and permit both two materials (1)(2) to be moved by the movable guide member (3) towards the sewing machine (M).

Then, as indicated by the arrow in FIG. 11, the movable guide plate (3) is moved by operation of a cylinder (not shown) along the guide grooves (41) to subject the thus-juxtaposed first and second base materials (1)(2) to sewing by the sewing machine (M), so that the two juxtaposed edges (1A)(2A) of those two materials (1)(2) are sewn together by the sewing needle (N) of sewing machine (M) as indicated by the imaginary seam line (S) in FIG. 11.

Figure 12:
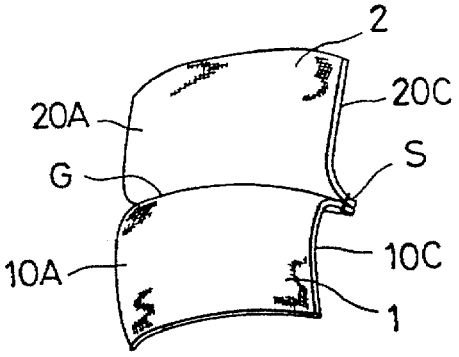
FIG. 12 is a perspective view of one embodiment of a trim cover assembly in accordance with the present invention.

At the completion of sewing, the two retaining devices (5)(5) are operated to withdraw their respective sets of plural needles (50)(50) to a non-use position below the upper section (3A) of movable guide member (3), as shown in FIG. 7, to thereby release the sewn unit of first and second base materials (1)(2) from the retained and expanded state. Then, after that sewn unit is taken out from the movable guide member (3), the second base material (2) is turned over from the first base material (1) relative to the seam (S), as can be seen in FIG. 12, whereupon both lateral sides of first and second materials (1)(2) are warped backwardly relative to a central line, owing to the elastic contracting recovery force of the convexly curved edge portion (1A) of first material (1) which has been released from the expanded state as stated above. Accordingly, there is produced such three-dimensional arcuate body of trim cover assembly shown in FIG. 12, with an upwardly curved decorative groove (G) formed therein, which is able to closely cover the corresponding swollen cambered surface of cushion member (C) of the seat back (SB), as can be seen from FIG. 1.

Figure 9:
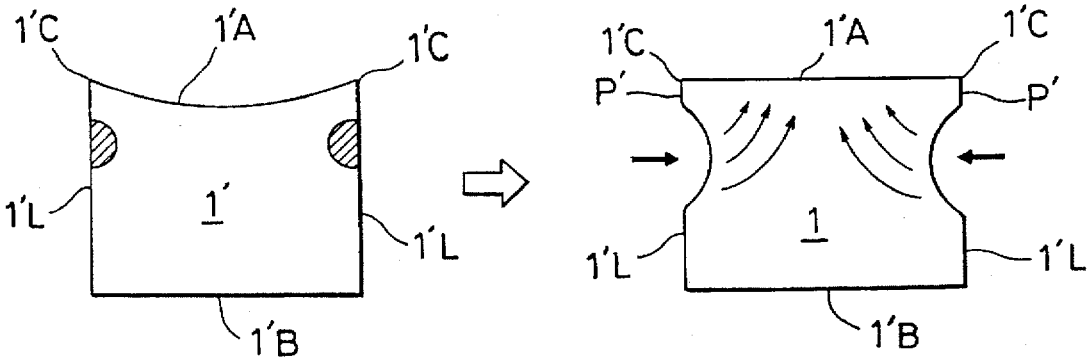
FIG. 9 is a diagram explaining how to contract another first base material to transform its concave edge into a rectilinear edge.

Reference is made to FIG. 9 which shows another first base material (1') with a concavely curved edge (1'A). In this case, as similar to the foregoing base material (1), a worker should grasp two upper areas respectively of two lateral edge portions (1'L)(1'L) of such first base material (1'), with his or her two respective hands, as indicated by the hatching in FIG. 8, which are each near to the two respective upper corners (1'C)(1'C) of same base material (1), while leaving a non-contracted margin (P') in each of the two respective lateral edge portions (1'L)(1'L) between the hatched grasped area and the upper corner (1C). Then, while abutting the curved edge (1'A) of base material (1') against the stationary guide member (40), he or she should contract those two particular hatched parts of same base material (1') inwardly towards each other, as indicated by the two thick arrows in FIG. 9, to the degree at which the concavely curved edge (1'A) is transformed into a rectilinear edge provisionally. Here, it is also important that, as indicated by the plural small arrows in FIG. 9, the worker should contract those two hatched parts of base material (1') towards each other in upward directions, by an amount enough to upheave the concavely curved edge (1'A) to a rectilinear line forming a provisional rectilinear edge (1A) equal in length to the opposite rectilinear edge (1B), as seen in FIG. 9. Subsequent thereto, as understandable by the one-dot chain lines in FIG. 10, the two non-contracted margins (P')(P') of base material (1') are each placed on the respective two sets of plural needles (50)(50) projected from the upper section (3A) of movable guide member (3), as best shown in FIG. 6, so that the back cloth layer (1'C) of same material (1') is stuck and caught by the needles (50). In this way, the provisional rectilinear edge (1'A) of base material (1) is retained at a predetermined position, as it is shown in FIG. 10, against deformation, by means of the two retaining devices (5)(5) and one stationary guide member (40), with the whole sheet of base material (1') being placed on the movable guide member (3).

Figure 13:
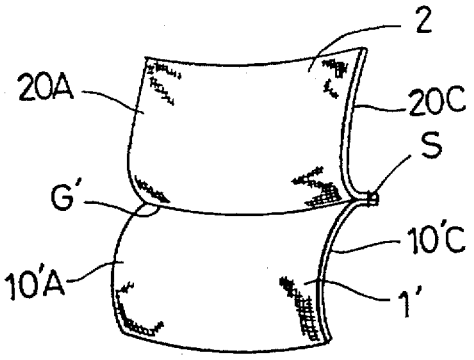
FIG. 13 is a perspective view of another embodiment of a trim cover assembly in accordance with the present invention.

Then, all the subsequent steps are executed in the same manner with the previous first base material (1) as described above: Namely, in brief, the turned-over second base material (2) is placed on the frontal surface (10'A) of first base material (1') secured on the movable guide member (3), such that the rectilinear edge (2A) of the former (2) is juxtaposed fit with the provisional rectilinear edge (1'A) of the latter (1'), while being abutted along and against the stationary guide member (40), and then, as indicated by the arrow in FIG. 11, the movable guide plate (3) is moved by operation of a cylinder (not shown) along the guide grooves (41) to subject the thus-juxtaposed first and second base materials (1')(2) to sewing by the sewing machine (M) as indicated by the imaginary seam line (S) in FIG. 11, after which, a resulting sewn unit of first and second materials (1')(2) is taken out from the movable guide member (3). The second base material (2) is then turned over from the first base material (1') relative to the seam (S), as can be seen in FIG. 13, whereupon both lateral sides of first and second materials (1')(2) are warped backwardly relative to a central line, owing to the elastic expanding recovery force of the concavely curved edge portion (1'A) of first material (1') which has been released from the contracted state as stated above. Accordingly, there is produced such another three-dimensional arcuate body of trim cover assembly shown in FIG. 13, with a downwardly curved decorative groove (G') formed therein, which is able to closely cover the corresponding swollen cambered surface of cushion member (C) of the seat back (SB), as can be seen from FIG. 1.

Of course, in the case where both two base materials are of a mere rectangular shape having all four rectilinear edges, the guide device described above can be used to secure them at a predetermined position thereon through the retaining and pressing devices (5)(6) as well as the stationary guide member (4) and subject their juxtaposed edge portions to sewing by the sewing machine (M) in the same procedures as stated above. But, in this case, there is no need to expand or contract the materials themselves.

It will be appreciated that in accordance with the present invention, a curved edge of one base material can be juxtaposed with a rectilinear edge of another base material through the simple manual expanding or contracting steps mentioned above, and further those two base materials can be readily retained and guided by the very simplified guide device (3, 4, 5, 6) towards the sewing machine (M) so as to be sewn with each other. After the sewing, a three-dimensional trim cover assembly is formed by turning over one of the two materials from another of them relative to a seam or juncture therebetween.

While having described the present invention thus far, it should be understood that the invention is not limited to the illustrated embodiments, but may be modified in any other way, with its related structural replacements and additions, without departing from the scopes of the appended claims. For instance, instead of the two sets of plural needles (50), a plurality of other pressing retainers, such as clips, may be used to retain the first base material (1 or 1') on the movable guide member (3).

What is claimed is:

1. A method for sewing a curved edge of a first base material with an edge of a second base material to form a trim cover assembly, said method comprising the steps of:

preforming said first base material from an expansible elastic material;

providing a guide means for securing thereon said first and second base materials and guiding them towards a sewing machine;

deforming said first base material elastically from an original shape thereof in such a manner as to transform the curved edge thereof into a provisional rectilinear edge;

retaining the thus-deformed first base material with said provisional rectilinear edge, upon said guide means;

thereafter, placing said second base material onto said deformed first base material retained on said guide means, such that the edge of said second base material is juxtaposed with said provisional rectilinear edge of said deformed first base material;

causing said guide means, on which said deformed first base material and said second base materials are placed, to be moved towards said sewing machine;

sewing the edge of said second base material with the provisional rectilinear edge of said deformed first base material by means of said sewing machine; and thereafter, removing said deformed first base material and said second base material from said guide means, whereby said first base material is elastically recovered into said original shape, with said provisional rectilinear edge thereof being returned to said curved edge.

2. The method as defined in claim 1, wherein said guide means comprises: a movable guide member having a section on which said deformed first base material is to be placed; and a retaining device for retaining said deformed first base material on said section of Said movable guide member, and wherein said retaining device includes at least two sets of plural needles by which said deformed base material with the provisional rectilinear edge is retained.

3. The method as defined in claim 1, wherein said guide means comprises: a movable guide member having a section on which said deformed first base material is to be placed; a stationary guide member; and a retaining device for retaining said deformed first base material on said section of said movable guide member, and wherein the method further includes the steps of abutting said provisional rectilinear edge of said deformed first base material against said stationary guide member and retaining said deformed first base material on said section of said movable guide member by means of said retaining device.

4. The method as defined in claim 1, wherein the edge of said second base material is of a generally rectilinear shape.

5. The method as defined in claim 1, wherein said curved edge of said first base material is of a convexly curved shape, and wherein, at said step of deforming said first base material elastically from the original shape thereof, the method includes the step of expanding said first base material in such a manner as to flatten said convexly curved edge into the provisional rectilinear edge.

6. The method as defined in claim 1, wherein said curved edge of said first base material is of a concavely curved shape, and wherein, at said step of deforming said first base material elastically from the original shape thereof, the method includes the step of contracting said first base material in such a manner as to upheave said convexly curved edge into the provisional rectilinear edge.

7. The method according to claim 2, wherein said movable guide member includes a bottom section and an upstanding section, in addition to said section thereof, wherein said retaining device is disposed in a space defined among said section, said bottom section and said upstanding section, and wherein said section of said movable guide member is formed with at least two openings therein, each being adapted to allow the respective said at least two sets of plural needles of said retaining device to be projected therethrough and withdrawn therefrom.

8. The method according to claim 7, wherein said section is further so formed as to be inclined from a top of said upstanding section down to said bottom section.

9. The method as defined in claim 5, wherein at least two portions of said first base material adjacent to said convexly curved edge are expanded away from each other to a degree at which the convexly curved edge is flattened into said provisional rectilinear edge.

10. The method as defined in claim 6, wherein at least two portions of said first base material adjacent to said concavely curved edge are contracted towards each other to a degree at which the concavely curved edge is uphove into said provisional rectilinear edge.

11. The method as defined in claim 1, wherein, subsequent to said step of removing said deformed first base material and said second base material from said guide means, there is further provided the steps of turning over said second base material from said first base material which has been recovered into said original shape having the curved edge, in relation to a point where the edge of said second base material is sewn with the curved edge of said first base material, whereby a three-dimensional warped trim cover assembly is produced.

12. The method as defined in claim 1, wherein a pressing device is provided, which is operable to apply a pressure to said second base material placed onto said deformed first base material retained on said guide means, to thereby pressingly retain said second base material against dislocation from said deformed fist base material.

13. The method as defined in claim 1, wherein said first base material is of a three-layer lamination structure comprising a expansible top cover layer, a slab urethane foam layer and an expansible back cloth layer, in this order.

14. A method for sewing a curved edge of a first base material with an edge of a second base material to form a trim cover assembly, in which said first base material has a frontal surface and a reverse surface, and said second base material has a frontal surface and a reverse surface, said method comprising the steps of:

preforming said first base material from an expansible elastic material;

providing a guide means for securing thereon said first and second base materials and guiding them towards a sewing machine;

deforming said first base material elastically from an original shape thereof in such a manner as to transform the curved edge thereof into a provisional rectilinear edge;

retaining the thus-deformed first base material with said provisional rectilinear edge, upon said guide means, such that said frontal surface of said deformed first base material shows up on said guide means;

turning over said second base material to show up the reverse surface thereof;

placing the thus-turned-over second base material onto the frontal surface of said deformed first base material retained on said guide means, with said frontal surface of said turned-over second base material in contact on said frontal surface of said deformed first base material, such that the edge of said second base material is juxtaposed with said provisional rectilinear edge of said deformed first base material;

causing said guide means, on which said deformed first base material and said second base materials are placed, to be moved towards said sewing machine;

sewing the edge of said second base material with the provisional rectilinear edge of said deformed first base material by means of said sewing machine;

thereafter, removing said deformed first base material and said second base material from said guide means, whereby said first base material is elastically recovered into said original shape, with said provisional rectilinear edge thereof being returned to said curved edge; and then, again turning over said turned-over second base material from said first base material which has been recovered into said original shape having the curved edge, in relation to a point where the edge of said second base material is sewn with the curved edge of said first base material, whereby a three-dimensional warped trim cover assembly is produced.

15. The method as defined in claim 14, wherein said first base material is of a three-layer lamination structure comprising a expansible top cover layer corresponding to said frontal surface of the first base material, a slab urethane foam layer and an expansible back cloth layer corresponding to said reverse surface of the same first base material, in this order.

* * * * *